US008927842B1

(12) United States Patent
Honjo

(10) Patent No.: US 8,927,842 B1
(45) Date of Patent: Jan. 6, 2015

(54) DRUM SYSTEM

(71) Applicant: Hoshino Gakki Co., Ltd., Nagoya, Aichi (JP)

(72) Inventor: Atsushi Honjo, Nagoya (JP)

(73) Assignee: Hosino Gakki Co., Ltd, Aichi (JP)

( * ) Notice: Subject to any disclaimer, the term of this patent is extended or adjusted under 35 U.S.C. 154(b) by 0 days.

(21) Appl. No.: 14/069,377

(22) Filed: Nov. 1, 2013

(30) Foreign Application Priority Data

Aug. 23, 2013 (JP) ..... 2013-173263

(51) Int. Cl.
*G10D 13/02* (2006.01)

(52) U.S. Cl.
CPC ..... *G10D 13/026* (2013.01); *G10D 13/025* (2013.01); *G10D 13/02* (2013.01)
USPC ..... 84/411 R; 84/421

(58) Field of Classification Search
CPC ..... G10D 13/02; G10D 13/026
See application file for complete search history.

(56) References Cited

U.S. PATENT DOCUMENTS

| | | | | | |
|---|---|---|---|---|---|
| 938,899 | A | * | 11/1909 | Schipper | 84/422.2 |
| 2,548,271 | A | * | 4/1951 | Percy | 84/411 R |
| 3,677,128 | A | * | 7/1972 | Simpson | 84/422.1 |
| 4,168,646 | A | * | 9/1979 | May | 84/723 |
| 4,300,437 | A | * | 11/1981 | Hinger et al. | 84/411 R |
| 6,211,448 | B1 | | 4/2001 | Shigenaga et al. | |
| 7,528,312 | B1 | * | 5/2009 | DiGiovanni | 84/411 R |
| 7,781,660 | B2 | * | 8/2010 | Paterson | 84/412 |
| 7,786,364 | B2 | | 8/2010 | Natali | |
| 2004/0025664 | A1 | * | 2/2004 | Bennett | 84/411 P |
| 2012/0000343 | A1 | * | 1/2012 | Rothenberg | 84/421 |

FOREIGN PATENT DOCUMENTS

JP 3543622 B2 7/2004

* cited by examiner

*Primary Examiner* — Robert W Horn

(57) ABSTRACT

The drum system has a floor tom, a bass drum, a tom-tom, a snare drum, legs, rods, attachment tools, first and second brackets, and the like. The floor tom is set with a drumhead facing upward, and the bass drum is set with a drumhead facing downward, via the three rods and the first and second brackets. The floor tom is set above the bass drum with a space therebetween via the three rods and the first and second brackets.

9 Claims, 8 Drawing Sheets

DRUM SYSTEM

BACKGROUND OF THE INVENTION

The present invention relates to a drum system.

For example, Japanese Patent No. 3543622 suggests a compact, easy-to-carry drum set. This drum set is configured such that a tom, a snare drum, and the like can be stowed inside a bass drum, which is split into two shell segments. In this configuration, to secure the space for stowing the tom and the snare drum inside the bass drum, it is necessary to increase the diameter and the depth of the bass drum. Furthermore, during a performance, the tom, the snare drum, and the like are attached to the outer circumferential surface of the bass drum via attachment fixtures. At this time, since the bass drum is set to face sideways, a sufficient space is required to accommodate the drum set. Therefore, the drum set disclosed in this document is not suited for performances held in small spaces, such as in a bar and on a street.

On the other hand, a cocktail drum system has been suggested that is suited for performances in such small spaces. A cocktail drum has a long-bodied shell and a pair of drumheads attached to the upper and lower open ends of the shell. Similarly to a floor tom, the cocktail drum is set to face vertically during use. A player strikes the lower drumhead with a pedal and strikes the upper drumhead with sticks. That is to say, the player strikes the upper drumhead in a manner similar to a tom and a snare drum and strikes the lower drumhead in a manner similar to a bass drum. The cocktail drum is tuned by adjusting the tension of each of the upper and lower drumheads by rotation of a plurality of lug bolts arranged on the outer circumferential surface of the shell.

However, in the case of a cocktail drum, a drumhead of a tom or a snare drum and a drumhead of a bass drum are attached to a single shell. In this configuration, tuning for one drumhead is easily influenced by tuning for the other drumhead via the shell. This leads to, for example, interference between the sound of the upper drumhead and the sound of the lower drumhead. For this reason, each drumhead can be tuned only within a small range. As a result, the cocktail drum cannot be tuned sufficiently, and the sound made by striking each drumhead is not able to resonate sufficiently.

SUMMARY OF THE INVENTION

It is an objective of the present invention to provide a drum system that enables wide-range tuning without impairing the functions of a cocktail drum.

To achieve the foregoing objective and in accordance with one aspect of the present invention, a drum system having a first drum, a second drum different from the first drum, and a plurality of legs is provided. The plurality of legs are arranged on at least one of the outer circumferential surfaces of the shells of the first and second drums, and are used to set the first and second drums along the vertical direction. The timbre of the first drum is different from the timbre of the second drum. The first and second drums are set with the drumhead of the first drum facing upward, and with the drumhead of the second drum facing downward. The first drum is set above the second drum with a space therebetween.

DETAILED DESCRIPTION OF THE PREFERRED EMBODIMENTS

First Embodiment

One embodiment of a drum system 10 according to the present invention will now be described with reference to FIGS. 1 to 10. The drum system 10 is described herein with the front side and the back side considered to be the audience side and the player side, respectively.

Figure 1:
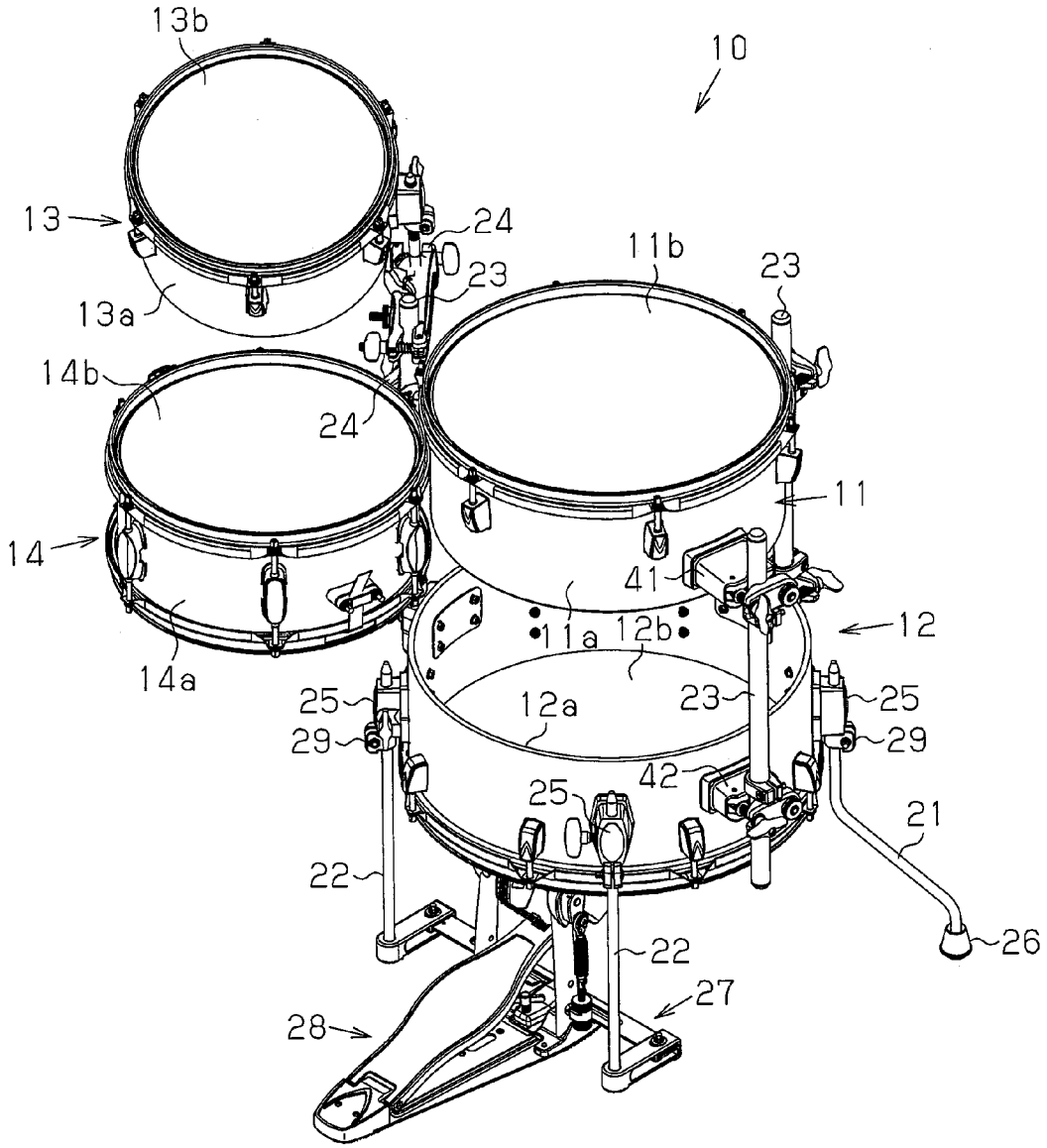
FIG. 1 is a perspective view showing a mode of a drum system according to one embodiment of the present invention during a performance.

As shown in FIG. 1, the drum system 10 has a floor tom 11 as a first drum, a bass drum 12 as a second drum, a tom-tom 13 as a third drum, and a snare drum 14 as a fourth drum.

The floor tom 11 has a shell 11*a* and a drumhead 11*b* attached to the upper open end of the shell 11*a*. The bass drum 12 has a shell 12*a* and a drumhead 12*b* attached to the lower open end of the shell 12*a*. The snare drum 14 has a shell 14*a*, a pair of drumheads 14*b* attached to the upper and lower open ends of the shell 14*a*, and a snare wire, which is not shown in the figures. The tom-tom 13 has a shell 13*a* and a drumhead 13*b* attached to the upper open end of the shell 13*a*.

The drum system 10 also has four legs 21, 22, three rods 23, and two attachment tools 24 for setting the floor tom 11, the bass drum 12, the tom-tom 13 and the snare drum 14. The legs 21, 22 are used for setting the floor tom 11 and the bass drum 12 along the vertical direction. The rods 23 are used to support the floor tom 11 above the bass drum 12. The attachment tools 24 are used to attach the tom-tom 13 and the snare drum 14 to the corresponding rod 23.

Out of the four legs 21, 22, each of the front legs 21 is made of a metal bar that is bent obliquely at the center and the distal end thereof. Each of the back legs 22 is made of a metal bar extending straight. The legs 21, 22 are fixed to the outer circumferential surface of the shell 12*a* of the bass drum 12 via fixtures 25 at substantially equal angular intervals. The legs 21, 22 are attached by being inserted into corresponding holes in the fixtures 25 from below. Antiskid rubber caps 26 are fitted on the distal ends of the front legs 21. A pedal apparatus 28 for striking the bass drum 12 is connected to the back legs 22 via a connection mechanism 27. Memory locks 29 for memorizing the attached position of the bass drum 12 are attached to the front legs 21 and the back legs 22.

Figure 2:
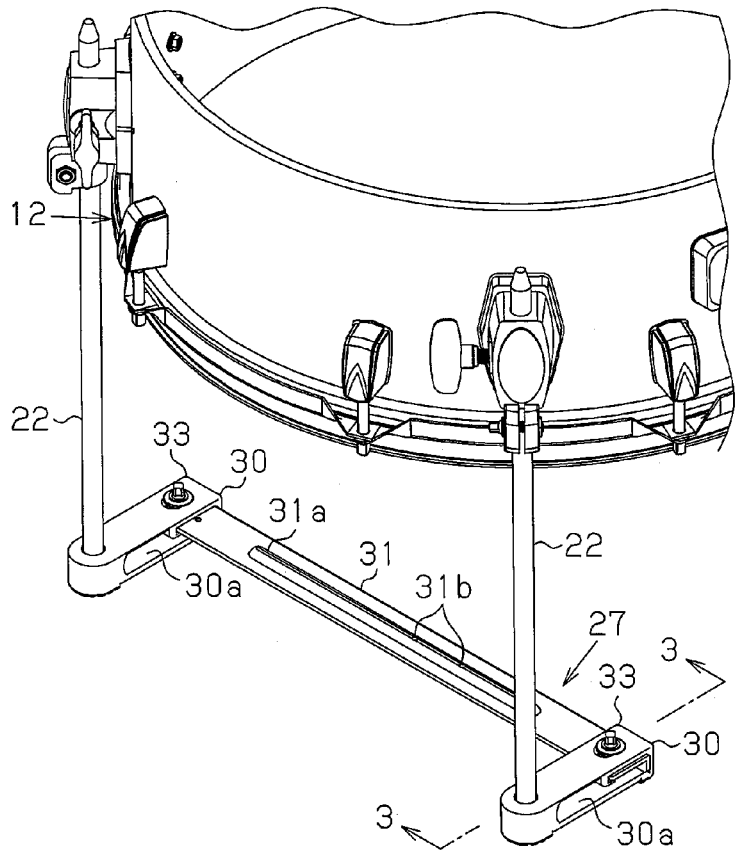
FIG. 2 is a perspective view showing a connection mechanism for connecting a pedal apparatus to the drum system.
Figure 3:
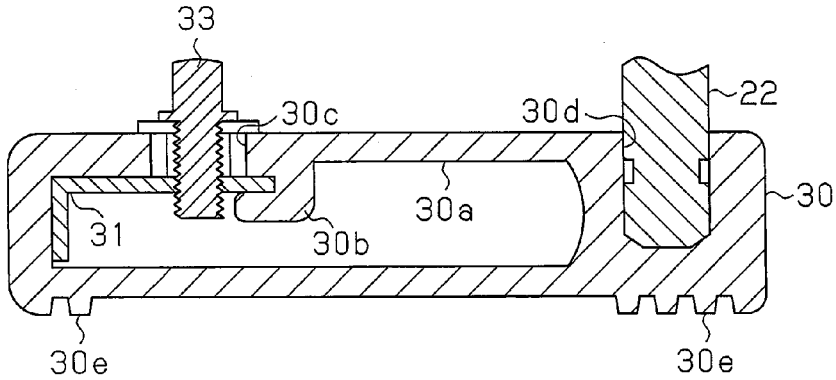
FIG. 3 is a cross-sectional view taken along the line 3-3 in FIG. 2.

As shown in FIGS. 2 and 3, the connection mechanism 27 has the pair of back legs 22, a pair of leg rubbers 30, and a connection plate 31 serving as a connection member. Each leg rubber 30 is substantially cuboid and has a hollow portion 30*a* inside thereof. An L-shaped projection 30*b* for holding the connection plate 31 is formed on the inner surface of the leg rubber 30 forming the hollow portion 30*a*. A through-hole 30*c*, which communicates with the hollow portion 30*a*, and a fixing hole 30*d*, which does not communicate with the hollow portion 30*a*, are formed on the upper surface of the leg rubber 30. The lower end of the corresponding back leg 22 is inserted into and fixed to the fixing hole 30*d* in the leg rubber 30. Antiskid stoppers 30*e* are formed on the lower surface of the leg rubber 30.

The connection plate 31 is made of a stiff material, such as metal. The connection plate 31 is formed by bending an elongated plate into the shape of an L in a cross-section. A convex portion 31*a* extending in the longitudinal direction of the connection plate 31 is formed on the connection plate 31. As shown in FIG. 2, two marks 31*b*, which indicate the positions of connection to the pedal apparatus 28, are impressed slightly to the right of the center of the convex portion 31*a* when viewed from the player side. The positions of the two marks 31*b* are set in such a manner that, when the pedal apparatus 28 is located between the two marks 31*b* in a connected state, a beater 37 strikes the drumhead 12*b* of the bass drum 12 in the vicinity of the center thereof.

The connection plate 31 is located across the pair of leg rubbers 30 with the surface having the convex portion 31*a* facing upward. The connection plate 31 is connected to the lower ends of the pair of back legs 22 via the two leg rubbers 30. The end portions of the connection plate 31 are inserted into the hollow portions 30*a* in the leg rubbers 30 from a lateral side. Inside each hollow portion 30*a*, a part of the connection plate 31 is held in a clearance between the inner surface of the leg rubber 30 and the projection 30*b*. Furthermore, a corner portion of the connection plate 31 adheres to a corner portion of each leg rubber 30 forming the hollow portion 30*a*. Both ends of the connection plate 31 are fixed to the leg rubbers 30 by means of screws 33, which extend through the through-holes 30*c*, while being arranged inside the hollow portions 30*a* in the above manner.

Figure 4:
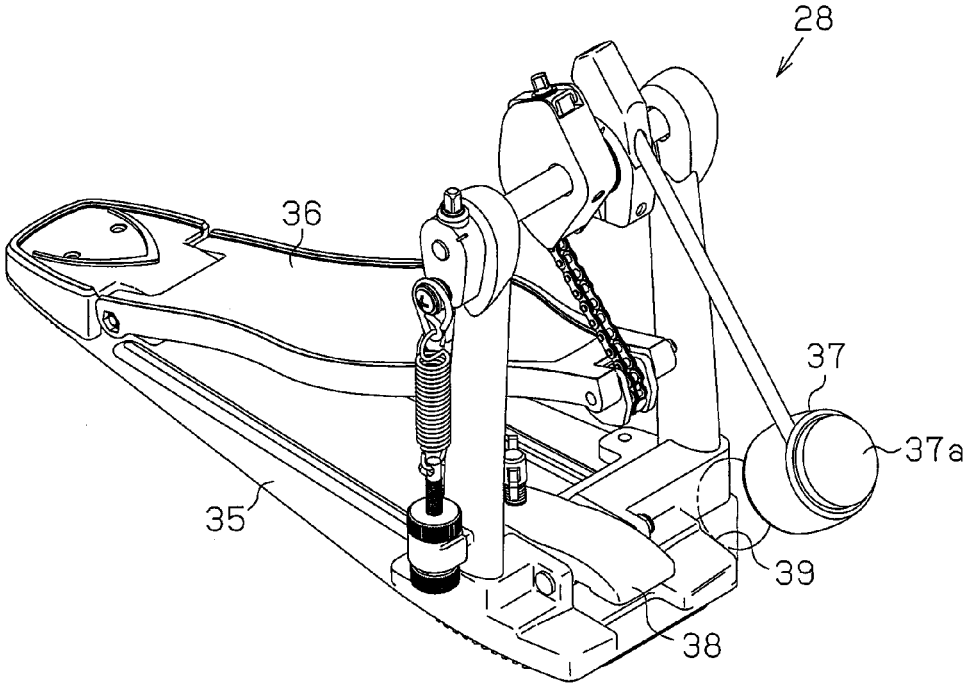
FIG. 4 is a perspective view showing the pedal apparatus.
Figure 5:
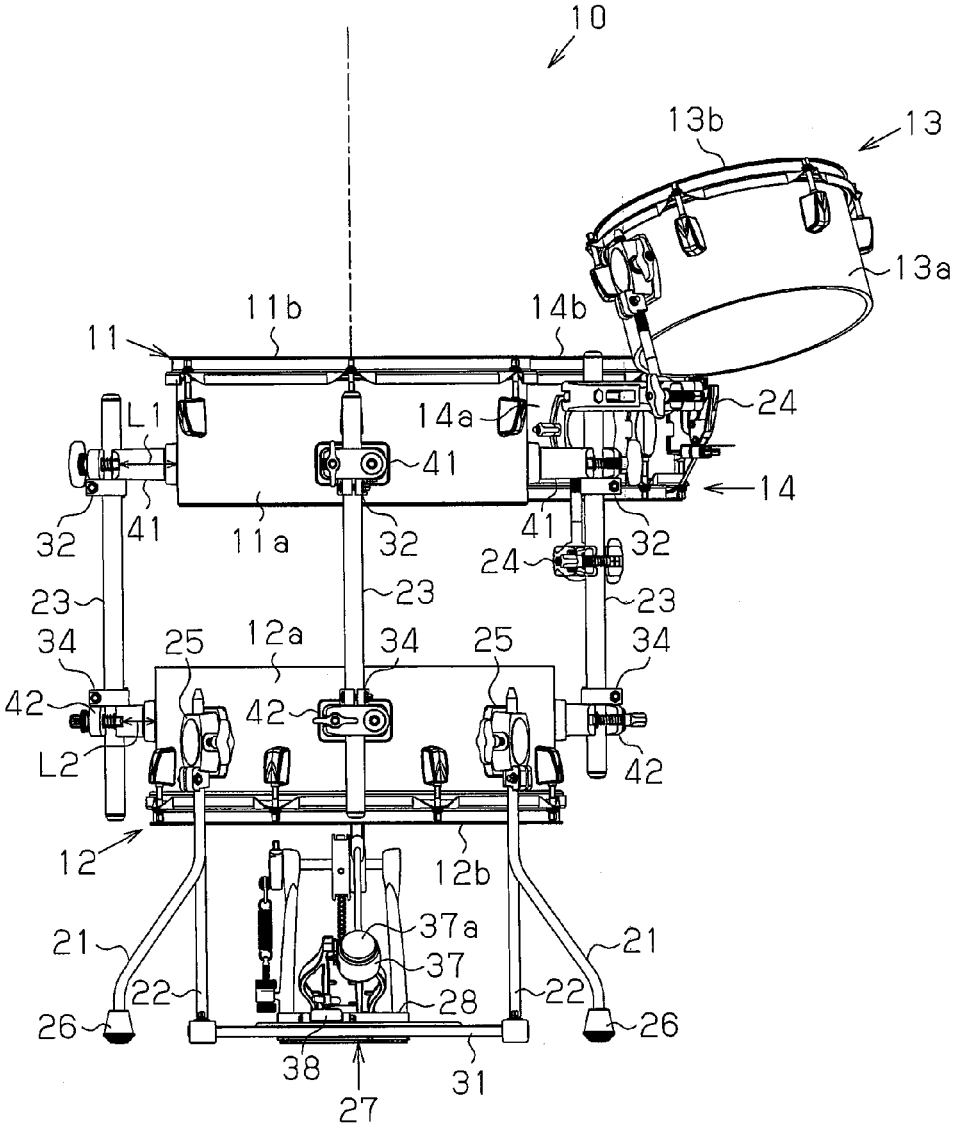
FIG. 5 is a front view showing a mode of the drum system during a performance.

As shown in FIGS. 4 and 5, the pedal apparatus 28 has a base plate 35, a pedal 36, a beater 37, and a clamp 38. The pedal apparatus 28 is connected to the substantial center of the connection plate 31 by means of the clamp 38. The pedal apparatus 28 is arranged with a beater head 37*a* of the beater 37 facing the bass drum 12. The pedal apparatus 28 is configured such that moving the pedal 36 up and down with a foot makes the beater 37 pivot up and down in a reciprocating fashion.

A recess 39 is formed on the front end of the pedal apparatus 28 in a position corresponding to the beater 37. When the pedal apparatus 28 is viewed from the front, the recess 39 is arranged at the opposite side from the clamp 38. As indicated by an alternate long-and-two-short dashed line in FIG. 4, the recess 39 forms a space for avoiding interference between the beater 37 and the pedal apparatus 28 when the beater 37 moves to the lowest point.

As shown in FIGS. 1 and 5, during a performance, the floor tom 11 and the bass drum 12 are set with the drumhead 11*b* of the floor tom 11 facing upward, and with the drumhead 12*b* of the bass drum 12 facing downward, via the three rods 23. Memory locks 32 for memorizing the attached position of the floor tom 11 are attached to the rods 23 in the vicinity of the upper ends thereof. Similarly, memory locks 34 for memorizing the attached position of the bass drum 12 are attached to the rods 23 in the vicinity of the lower ends thereof.

The floor tom 11 is set coaxially with and above the bass drum 12 with a space therebetween, via the three rods 23 and first and second brackets 41, 42 supported by the rods 23. In this state, the floor tom 11 is set such that the spatial distance between itself and the bass drum 12 is adjustable via the rods 23 and the first and second brackets 41, 42.

The first brackets 41 are fixed to the outer circumferential surface of the shell 11*a* of the floor tom 11 at a substantially equal angular interval. The second brackets 42 are fixed to the outer circumferential surface of the shell 12*a* of the bass drum 12 at a substantially equal angular interval. As shown in FIG. 5, one of the three second brackets 42 is arranged between two fixtures 25 into which the front legs 21 are inserted. As shown in FIG. 1, the remaining two second brackets 42 are each arranged between the fixture 25 into which one of the front legs 21 is inserted and the fixture 25 into which one of the back legs 22 is inserted. The first and second brackets 41, 42 are supported movably with respect to the rods 23.

Figure 6:
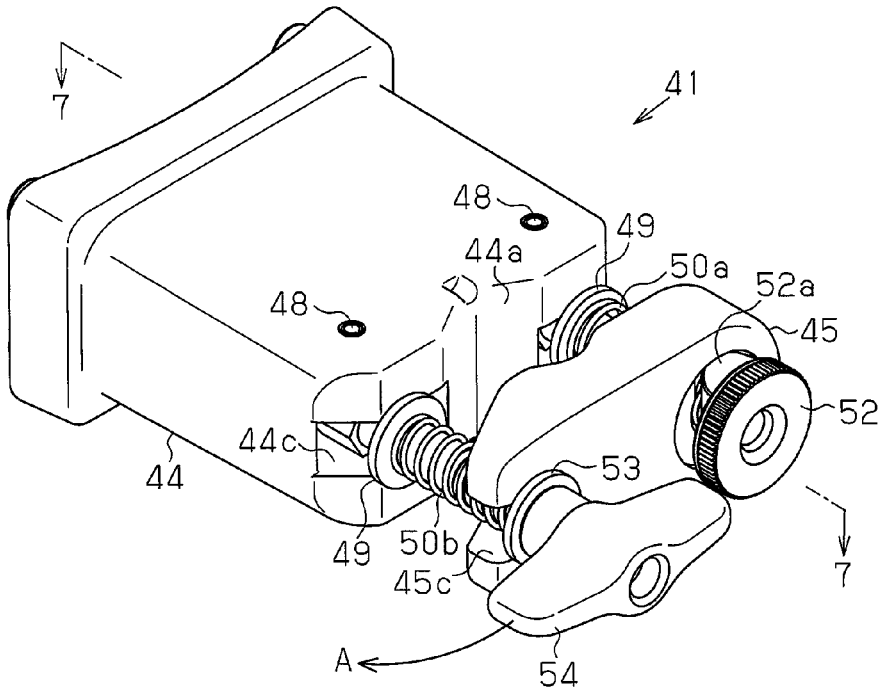
FIG. 6 is a perspective view showing a first bracket.
Figure 7:
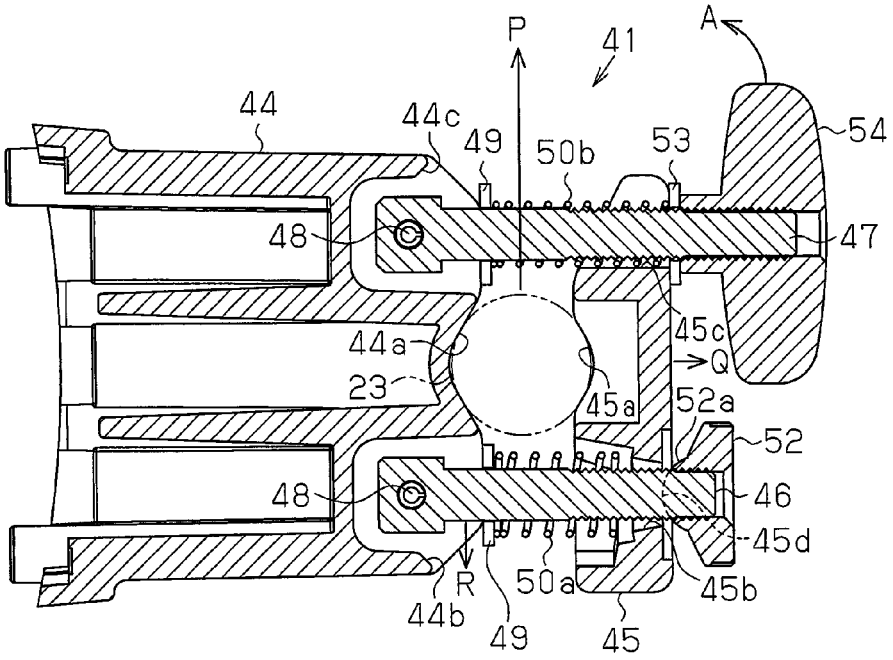
FIG. 7 is a cross-sectional view taken along the line 7-7 in FIG. 6.

As shown in FIGS. 6 and 7, each first bracket 41 has a bracket body 44 fixed to the shell 11*a* of the floor tom 11, a clamp piece 45 attached to the bracket body 44, and a pair of bolts 46, 47. The bracket body 44 has a support recess 44*a* and a pair of arrangement holes 44*b*, 44*c* on the surface opposing the clamp piece 45. The support recess 44*a* supports the corresponding rod 23. The first and second bolts 46, 47 are attached to the pair of arrangement holes 44*b*, 44*c*. On the other hand, the clamp piece 45 has a support recess 45*a*, a through-hole 45*b*, and a support recess 45*c* on the surface opposing the bracket body 44. The support recess 45*a* supports the corresponding rod 23. The first bolt 46 is inserted through the through-hole 45*b*. The support recess 45*c* supports the bolt 47.

The proximal end of the first bolt 46 and the proximal end of the second bolt 47 are arranged in the arrangement holes 44*b* and 44*c* in the bracket body 44, respectively. The first and second bolts 46, 47 are attached pivotally with respect to the bracket body 44 via pins 48.

The distal end of the first bolt 46 extends through the through-hole 45*b* in the clamp piece 45 and is threaded into a nut 52. The nut 52 has a projecting portion 52*a* having a semicircular cross-section on the surface opposing the clamp piece 45. On the other hand, the clamp piece 45 has a recess 45*d* having a semicircular cross-section in an area corresponding to the projecting portion 52*a*. A washer 49 and a coiled spring 50*a* are attached to a shaft portion of the first bolt 46. The coiled spring 50*a* is compressed between the bracket body 44 and the clamp piece 45. Hence, the projecting portion 52*a* of the nut 52 is pressed against the recess 45*d* in the clamp piece 45.

The distal end of the second bolt 47 passes through the support recess 45*c* in the clamp piece 45 and is threaded into a butterfly nut 54 via a washer 53. A washer 49 and a coiled spring 50*b* are attached to a shaft portion of the second bolt 47. Similarly to the coiled spring 50*a*, the coiled spring 50*b* is compressed between the bracket body 44 and the clamp piece 45.

In each first bracket 41, fastening the butterfly nut 54 onto the second bolt 47 makes the corresponding rod 23 clamped and fixed between the bracket body 44 and the clamp piece 45. Conversely, loosening the butterfly nut 54 releases the fixed state of the corresponding rod 23 with respect to the first bracket 41, thereby making the first bracket 41 slidable with respect to the corresponding rod 23. By thus making the three first brackets 41 slidable with respect to the rods 23, the spatial distance between the floor tom 11 and the bass drum 12 can be adjusted.

To remove the corresponding rod 23 from each first bracket 41, the butterfly nut 54 is loosened, and then the second bolt 47 is pivoted in direction A indicated in FIGS. 6 and 7 with respect to the bracket body 44. Thereafter, only by moving the corresponding rod 23 in horizontal direction P perpendicular to the axis thereof, the corresponding rod 23 is removed from the first bracket 41. At this time, the clamp piece 45 pivots in direction Q indicated in FIG. 7 with the inner surface of the recess 45*d* sliding along the circular arc surface of the projecting portion 52*a*. Furthermore, the first bolt 46 pivots about the corresponding pin 48 in direction R indicated in FIG. 7. Consequently, the corresponding rod 23 moves in horizontal direction P and is removed from the first bracket 41 while pushing the first bracket 41 and the clamp piece 45 to enlarge the clearance therebetween. To attach and fix the rods 23 to the first brackets 41, the removal procedure of the rods 23 is performed in reverse order.

As shown in FIG. 5, the second brackets 42 have the same configuration as the first brackets 41, except that the bracket bodies of the second brackets 42 are shorter than the bracket bodies 44 of the first brackets 41. More specifically, in order to coaxially arrange the floor tom 11 and the bass drum 12, the overall length L1 of the first brackets 41 is set to be longer than the overall length L2 of the second brackets 42. Note that the overall lengths L1, L2 of the first and second brackets 41, 42 denote the lengths in a direction perpendicular to the axes of the rods 23.

As shown in FIG. 5, when viewed from the audience side, the tom-tom 13 and the snare drum 14 are set on the right of the floor tom 11 and the bass drum 12 with the drumheads 13*b*, 14*b* facing upward. The drumhead 14*b* of the snare drum 14 is set roughly at the same height as the drumhead 11*b* of the floor tom 11. The drumhead 13*b* of the tom-tom 13 is set at a position higher than those of the drumheads 11*b*, 14*b* of the floor tom 11 and the snare drum 14. The snare drum 14 is attached to the corresponding rod 23 in the vicinity of the center of the corresponding rod 23 via one attachment tool 24. The tom-tom 13 is attached to the same rod 23 in the vicinity of the upper end of the same rod 23 via the other attachment tool 24.

Figure 8:
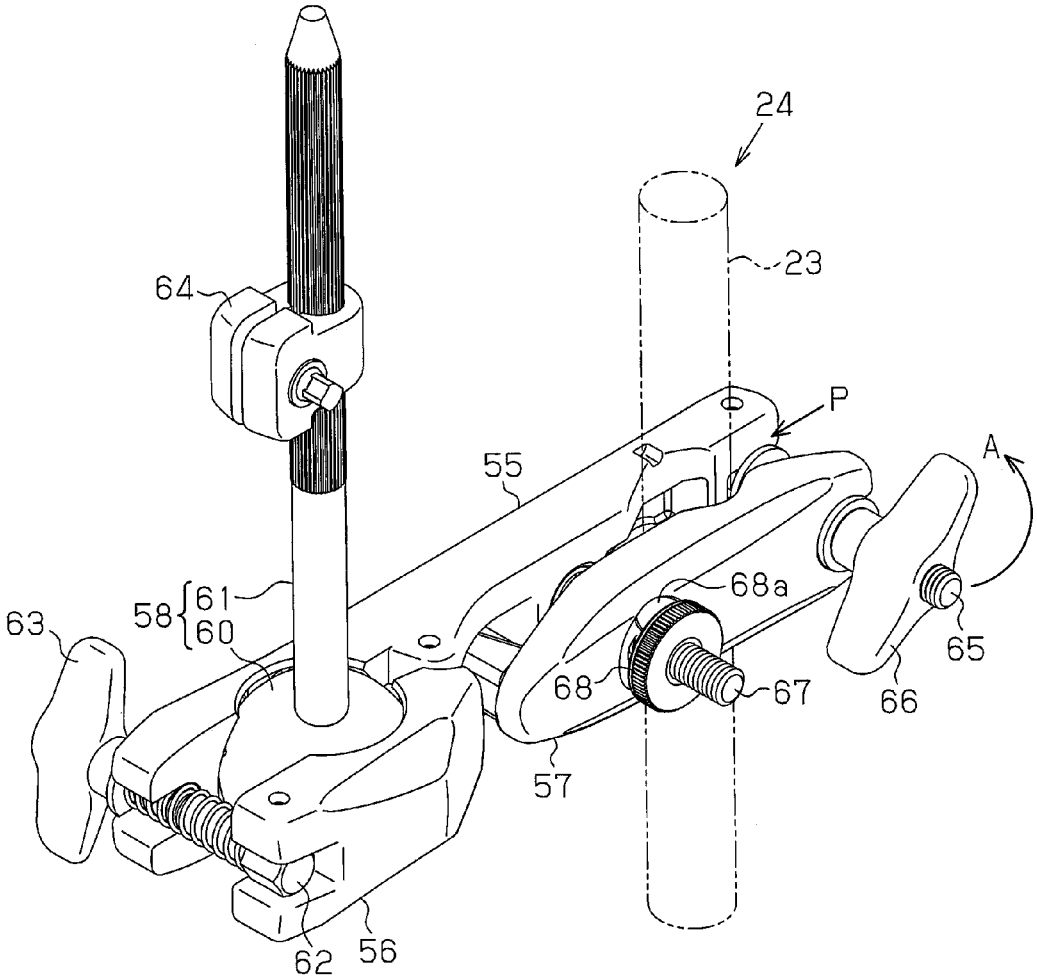
FIG. 8 is a perspective view showing an attachment tool for attaching and removing a tom-tom and a snare drum to and from a rod.

As shown in FIG. 8, each attachment tool 24 has a clamp body 55, a first clamp piece 56, a second clamp piece 57, and a pivoting member 58. The pivoting member 58 has a ball 60 and an I-shaped rod 61 projecting from the ball 60. A memory lock 64 for memorizing the attached position of the tom-tom 13 is attached to the rod 61 of one of the two attachment tools 24. Similarly, a memory lock 64 for memorizing the attached position of the snare drum 14 is attached to the rod 61 of the other attachment tool 24.

In each attachment tool 24, fastening a butterfly nut 63 threaded onto a first bolt 62 makes the ball 60 clamped between the clamp body 55 and the first clamp piece 56. Loosening the butterfly nut 63 in this state makes the ball 60 rotatable between the clamp body 55 and the first clamp piece 56, thereby enabling the pivoting member 58 to move forward, backward, leftward, and rightward. Furthermore, in each attachment tool 24, fastening a butterfly nut 66 threaded onto a second bolt 65 makes the corresponding rod 23 clamped and fixed between the clamp body 55 and the second clamp piece 57. Conversely, loosening the butterfly nut 66 releases the fixed state of the corresponding rod 23 with respect to the attachment tool 24, thereby making the attachment tool 24 slidable with respect to the corresponding rod 23. The positions of the tom-tom 13 and the snare drum 14 in the height direction, as well as the angles of the drumheads thereof, are adjusted by moving the pivoting member 58 forward, backward, leftward and rightward, and by adjusting the positions of the memory locks 64, in addition to sliding the attachment tools 24 with respect to the corresponding rod 23 in the above manner. To accommodate a rod 23 of a different diameter, the interval between the clamp body 55 and the second clamp piece 57 is adjusted by changing the amount by which a nut 68 is fastened onto a third bolt 67. Note that the nut 68, similarly to the nut 52, has a projecting portion 68*a* having a semicircular cross-section on the surface opposing the second clamp piece 57.

To remove each attachment tool 24 from the corresponding rod 23, the butterfly nut 66 is loosened, and then the second bolt 65 is pivoted in direction A indicated in FIG. 8 with respect to the clamp body 55. Thereafter, by moving the attachment tool 24 in horizontal direction P perpendicular to the axis of the corresponding rod 23, the attachment tool 24 is removed from the corresponding rod 23. At this time, the corresponding rod 23 causes the second clamp piece 57 to pivot in such a manner that the distal end thereof moves outward. Consequently, the attachment tool 24 is removed from the corresponding rod 23 with the corresponding rod 23 pushing the clamp body 55 and the second clamp piece 57 to enlarge the clearance therebetween. To attach and fix the attachment tools 24 to the corresponding rod 23, the removal procedure of the attachment tools 24 is performed in reverse order.

Figure 9:
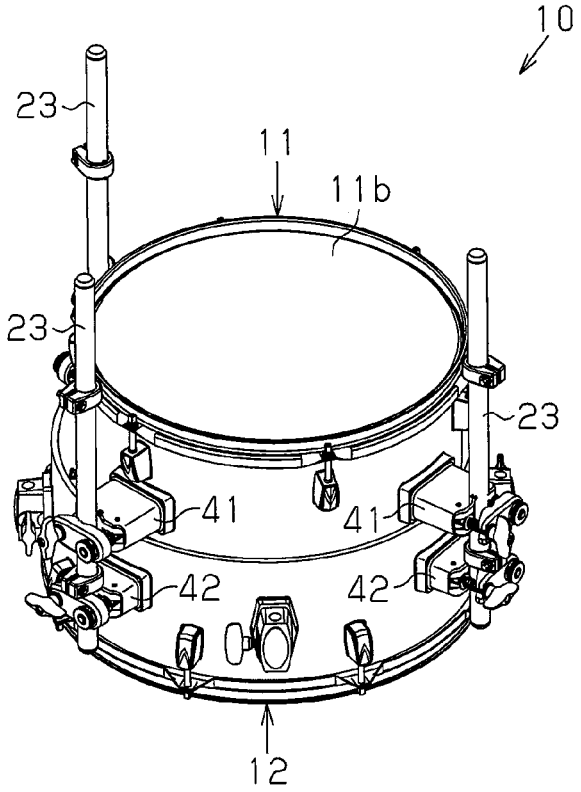
FIG. 9 is a perspective view showing the drum system in a stowing mode.
Figure 10:
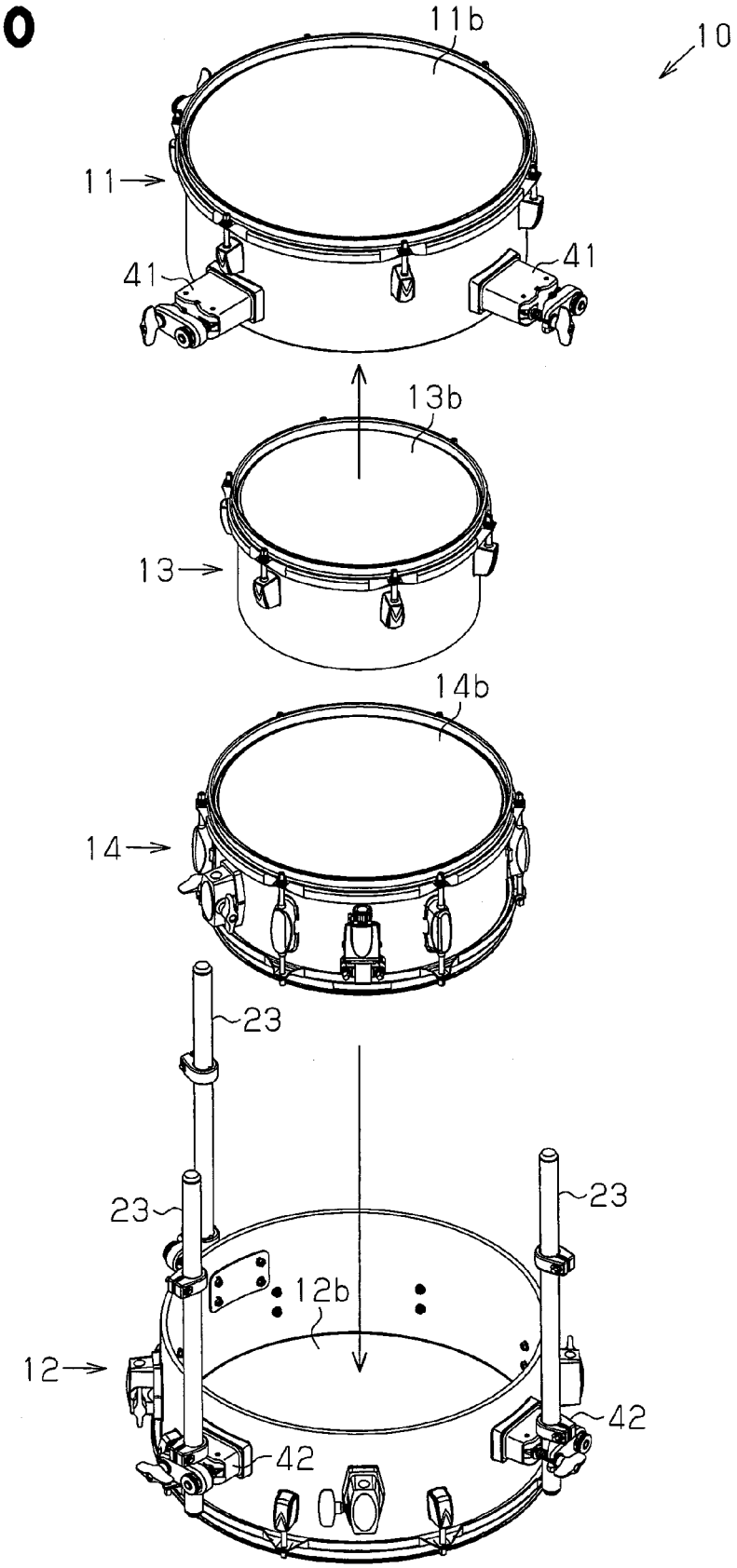
FIG. 10 is an exploded perspective view illustrating the drum system in the stowing mode.

As shown in FIGS. 9 and 10, the drum system 10 is configured such that the snare drum 14 and the tom-tom 13 can be stowed inside the floor tom 11 and the bass drum 12. Therefore, the diameter of the bass drum 12 is set to be larger than the diameter of the floor tom 11, the diameter of the floor tom 11 is set to be larger than the diameter of the snare drum 14, and the diameter of the snare drum 14 is set to be larger than the diameter of the tom-tom 13. More specifically, the diameter of the bass drum 12 is 16 inches, and the diameter of the floor tom 11 is 14 inches. Also, the diameter of the snare drum 14 is 12 inches, and the diameter of the tom-tom 13 is 10 inches.

To place the drum system 10 in a stowing mode, the bass drum 12, which has the largest diameter, is arranged with the drumhead 12*b* facing downward as shown in FIG. 10. At this time, the pedal apparatus 28, the front legs 21, the back legs 22, and the like have been removed from the bass drum 12, but the three rods 23 remain attached to the bass drum 12. Then, the snare drum 14 is stowed inside the bass drum 12 with the drumhead 14*b* facing upward.

Subsequently, the tom-tom 13 is arranged on the snare drum 14 with the drumhead 13*b* facing upward. Finally, the floor tom 11 is mounted on the bass drum 12 in such a manner as to stow therein the tom-tom 13, with the drumhead 11*b* facing upward. At this time, each first bracket 41 is arranged at the same position as the corresponding second bracket 42, and each rod 23 is inserted through the corresponding first bracket 41. In this way, the floor tom 11 is coaxially mounted on the bass drum 12. Similarly, inside the floor tom 11 and the bass drum 12, the tom-tom 13 is coaxially mounted on the snare drum 14.

Operation of the above-described drum system 10 will hereafter be described.

As shown in FIG. 1, the drum system 10 has the floor tom 11, the bass drum 12, the tom-tom 13, and the snare drum 14. The drum system 10 also has the legs 21, 22, the rods 23, the attachment tools 24, and the like as tools and components for setting the floor tom 11, the bass drum 12, the tom-tom 13, and the snare drum 14. According to this drum system 10, the floor tom 11 and the bass drum 12 are set with the drumhead 11*b* of the floor tom 11 facing upward, and with the drumhead 12*b* of the bass drum 12 facing downward, via the three rods 23. In this case, the player can strike the lower bass drum 12 with the pedal apparatus 28 and strike the upper floor tom 11 with sticks. In other words, the player can play the floor tom 11 and the bass drum 12 in a manner similar to a cocktail drum, which is set vertically during use.

Furthermore, according to this drum system 10, the floor tom 11 is set above the bass drum 12 with a space therebetween, via the three rods 23 and the first and second brackets 41, 42 supported by the rods 23. In this case, as the floor tom 11 is set above the bass drum 12 with a space therebetween, interference between the sound of the floor tom 11 and the sound of the bass drum 12 can be suppressed unlike a cocktail drum, in which drumheads are attached to the upper and lower open ends of one shell. This makes it possible to suppress the influence of tuning for the base drum 12 on tuning for the floor tom 11, and vice versa. Therefore, wide-range tuning can be performed for both of the floor tom 11 and the bass drum 12.

In view of the above, the present embodiment has the following advantages.

(1) The drum system 10 has the floor tom 11, the bass drum 12, and the legs 21, 22 for setting the floor tom 11 and the bass drum 12 along the vertical direction. The floor tom 11 is set above the bass drum 12 with a space therebetween via the three rods 23 and the first and second brackets 41, 42. In this configuration, the floor tom 11 and the bass drum 12 can be set with the drumhead 11*b* of the floor tom 11 facing upward, and with the drumhead 12*b* of the bass drum 12 facing downward. This makes it possible to use the floor tom 11 and the bass drum 12 in a manner similar to a cocktail drum, which is set vertically during a performance.

Furthermore, the floor tom 11 can be set above the bass drum 12 with a space therebetween. In this way, interference between the sound of the floor tom 11 and the sound of the bass drum 12 can be suppressed, and therefore wide-range tuning can be performed for both of the floor tom 11 and the bass drum 12. This makes it possible to provide the drum system 10 that enables wide-range tuning without impairing the functions of a cocktail drum.

(2) The diameter of the bass drum 12 is set to be larger than the diameter of the floor tom 11. In this configuration, due to the difference between the diameter of the floor tom 11 and the diameter of the bass drum 12, interference between the sound of the floor tom 11 and the sound of the bass drum 12 can be reduced. Therefore, each of the floor tom 11 and the bass drum 12 can easily be tuned. In addition, differences between the timbre of the floor tom 11 and the timbre of the bass drum 12 can be clarified. In this case, interference between the sound of the floor tom 11 and the sound of the bass drum 12 can be further reduced by increasing the difference between the diameter of the floor tom 11 and the diameter of the bass drum 12.

(3) The floor tom 11 is set in such a manner that a spatial distance between itself and the bass drum 12 is adjustable via the rods 23 and the first and second brackets 41, 42. In this configuration, interference between the sound of the floor tom 11 and the sound of the bass drum 12 can be reduced by increasing the spatial distance between the floor tom 11 and the bass drum 12. Therefore, each of the floor tom 11 and the bass drum 12 can easily be tuned. Furthermore, each of the floor tom 11 and the bass drum 12 can be tuned by adjusting the spatial distance between the floor tom 11 and the bass drum 12. Moreover, the position of the drumhead of the floor tom 11 can be set at an easy-to-play height by adjusting the spatial distance between the floor tom 11 and the bass drum 12.

(4) The drum system 10 has the rods 23 that support the floor tom 11 above the bass drum 12. The first brackets 41 are fixed to the outer circumferential surface of the shell 11*a* of the floor tom 11. The second brackets 42 are fixed to the outer circumferential surface of the shell 12*a* of the bass drum 12. The first and second brackets 41, 42 are supported movably with respect to the rods 23. In this configuration, the floor tom 11 and the bass drum 12 can be set while being aligned along the vertical direction via the rods 23. In this case, the use of long rods 23 enables a stand-up performance in a manner similar to a cocktail drum, and the use of short rods 23 enables a seated performance in a manner similar to a normal drum set. Furthermore, by moving the first brackets 41 and/or the second brackets 42 with respect to the rods 23, the spatial distance between the floor tom 11 and the bass drum 12 can easily be adjusted.

(5) The overall length L1 of the first brackets 41 is set to be longer than the overall length L2 of the second brackets 42. In this configuration, the floor tom 11 and the bass drum 12, which has a larger diameter than the floor tom 11, can be coaxially set while being aligned along the vertical direction. This makes it possible to reduce the space for setting the floor tom 11 and the bass drum 12 during a performance.

(6) The drum system 10 has the connection mechanism 27 for connecting the pedal apparatus 28 to the back legs 22. The connection mechanism 27 has the pair of back legs 22, the pair of leg rubbers 30, and the connection plate 31. In this configuration, the pedal apparatus 28 for striking the bass drum 12 can be connected, via the connection mechanism 27, to a part of the four legs 21, 22 for setting the floor tom 11 and the bass drum 12. This enables the player to strike the bass drum 12 by operating the pedal apparatus 28. The player can thus play the bass drum 12 in a manner similar to a bass drum of a cocktail drum.

(7) The drum system 10 has the tom-tom 13, the snare drum 14, and the attachment tools 24 in addition to the floor tom 11 and the bass drum 12. The attachment tools 24 are used to attach and remove the tom-tom 13 and the snare drum 14 to and from the corresponding rod 23. In this configuration, the tom-tom 13 and the snare drum 14 can be attached to and removed from the corresponding rod 23 via the attachment tools 24. Therefore, a dedicated stand for setting the tom-tom 13 and the snare drum 14 is unnecessary. This makes it possible to reduce the space for setting up the drum system 10 during a performance.

(8) The diameters of the bass drum 12 and the floor tom 11 are set to be larger than the diameters of the snare drum 14 and the tom-tom 13. In this way, the drum system 10 can be configured such that the tom-tom 13 and the snare drum 14 can be stowed inside the bass drum 12 and the floor tom 11. More specifically, the snare drum 14 is stowed inside the bass drum 12, and the floor tom 11 is mounted on the bass drum 12 in such a manner as to stow therein the tom-tom 13 placed on the snare drum 14. This makes it possible to provide the compact, easy-to-carry drum system 10 composed of four different types of drums.

(9) Each leg rubber 30 is substantially cuboid and has the hollow portion 30*a* inside thereof. In this configuration, the leg rubbers 30 easily deform due to the hollow portions 30*a*. Through this deformation of the leg rubbers 30, the load applied by stepping on the pedal 36 can be absorbed. Consequently, movement of the pedal apparatus 28, the bass drum 12, and the like caused by stepping on the pedal 36 can be suppressed whenever possible. Furthermore, the leg rubbers 30 may be configured to deform in conformity with the angle at which the floor tom 11 is set. This makes it possible to set the floor tom 11 with the drumhead set at an easy-to-play angle.

(10) The connection plate 31 is made of a stiff material, such as metal. The connection plate 31 is formed by bending an elongated plate into the shape of an L in a cross-section. In this configuration, the connection plate 31 has a sufficiently high strength, and therefore breakage and deformation of the connection plate 31 can be suppressed even if the player steps on the connection plate 31 by accident.

(11) Two marks 31*b*, which indicate the positions of connection between the connection plate 31 and the pedal apparatus 28, are impressed slightly to the right of the center of the convex portion 31*a* when viewed from the player side. The positions of the two marks 31*b* are set in such a manner that, when the pedal apparatus 28 is located between the two marks 31*b* in a connected state, the beater 37 strikes the bass drum 12 in the vicinity of the center thereof. In this configuration, the pedal apparatus 28 can be set in a manner similar to a normal drum set, thereby enabling the player to operate the pedal apparatus 28 without feeling any discomfort when playing the bass drum 12.

(12) The recess 39 is formed on the front end of the pedal apparatus 28 in a position corresponding to the beater 37. The recess 39 forms a space for avoiding interference between the beater 37 and the pedal apparatus 28 when the beater 37 moves to the lowest point. In this configuration, the movable range of the beater 37 can be secured to the same extent as in a normal pedal apparatus, in which a beater pivots forward and backward. Therefore, the player can operate the pedal apparatus 28 without feeling any discomfort when playing the bass drum 12.

(13) The lower ends of the back legs 22 are inserted into and fixed to the fixing holes 30*d* in the leg rubbers 30. In this configuration, the leg rubbers 30 can easily be removed from the back legs 22 by hand. In other words, the connection plate 31 can easily be removed from the two back legs 22 without using any tools and the like. This makes the operations for placing the drum system 10 in a stowing mode easy.

(14) In each first bracket 41, the distal end of the first bolt 46 extends through the through-hole 45*b* in the clamp piece 45 and is threaded into the nut 52. This configuration makes it possible to accommodate a rod 23 of a different diameter by adjusting the amount by which the nut 52 is fastened onto the first bolt 46. Furthermore, in each attachment tool 24, the third bolt 67 extends through the second clamp piece 57 and is threaded into the nut 68. This also makes it possible to accommodate a rod 23 of a different diameter by adjusting the amount by which the nut 68 is fastened onto the third bolt 67.

(15) Each first bracket 41 is configured as follows. The butterfly nut 54 is loosened, and then the second bolt 47 is pivoted in direction A indicated in FIGS. 6 and 7 with respect to the bracket body 44. Thereafter, only by moving the corresponding rod 23 in horizontal direction P, the corresponding rod 23 can easily be removed from the first bracket 41. In this case, the corresponding rod 23 can be removed by moving the corresponding rod 23 in horizontal direction P, instead of pulling the rod 23 out of the first bracket 41 in the direction of the axis thereof. Therefore, the rods 23 can be attached to and removed from the first brackets 41 without removing the memory locks 32, 34 from the rods 23. Also, each attachment tool 24 can easily be removed from the corresponding rod 23 only by moving the attachment tool 24 in horizontal direction P, in a manner similar to the first brackets 41.

(16) According to the drum system 10, as shown in FIG. 5, the floor tom 11, the bass drum 12, the tom-tom 13, and the snare drum 14 can be set in a playable manner even in a small space. The floor tom 11, the bass drum 12, the tom-tom 13, and the snare drum 14 are often set at positions adjacent to other neighboring instruments, the attachment tools 24, and the like. In view of this, the attachment tools 24 are configured in a manner attachable to the corresponding rod 23 even when they are upside down. That is to say, to make the rods 61 project from openings located on the lower surfaces of the clamp bodies 55, the attachment tools 24 can be attached to the corresponding rod 23 while being upside down. By thus changing the positions of projections of the rods 61 in accordance with the settings of various drums as necessary, neighboring different instruments do not interfere with one another.

The present embodiment may be modified as follows.

In the present embodiment, the drum system 10 may not include the tom-tom 13, the snare drum 14, and the attachment tools 24 for attaching and removing the tom-tom 13 and the snare drum 14 to and from the corresponding rod 23. In this case, the drum system 10 may be configured such that the floor tom 11 can be stowed inside the bass drum 12.

Although the first drum and the second drum are respectively the floor tom 11 and the bass drum 12 in the present embodiment, the first drum may instead be the tom-tom 13 or the snare drum 14. In the case where the first drum is the floor tom 11, the tom-tom 13 or the snare drum 14, the diameter thereof may be the same as the diameter of the bass drum 12.

In the present embodiment, the first and second brackets 41, 42 may be composed only of the bracket bodies 44 having through-holes in which the rods 23 are inserted, instead of being composed of the bracket bodies 44 and the clamp pieces 45. In this case, the first and second brackets 41, 42 may be supported respectively by the memory locks 32, 34 from below with the rods 23 inserted through the through-holes in the first and second brackets 41, 42.

In the present embodiment, to set the floor tom 11 and the bass drum 12 coaxially, it is sufficient to set the overall length L1 of the first brackets 41 and the overall length L2 of the second brackets 42 in accordance with the diameters of the floor tom 11 and the bass drum 12. For example, when the floor tom 11 and the bass drum 12 have the same diameter, it is sufficient to set the length L1 to be equal to the length L2. On the other hand, when the diameter of the floor tom 11 is larger than the diameter of the bass drum 12, it is sufficient to set the length L1 to be smaller than the length L2.

Although the legs 21, 22 are fixed to the outer circumferential surface of the shell 12*a* of the bass drum 12 in the present embodiment, they may instead be fixed to the shell 11*a* of the floor tom 11.

In the present embodiment, the drum system 10 may not include the connection mechanism 27 for connecting the pedal apparatus 28.

Although the snare drum 14 and the tom-tom 13 are stowed respectively inside the bass drum 12 and the floor tom 11 in the present embodiment, the snare drum 14 and the tom-tom 13 may instead be stowed respectively inside the floor tom 11 and the bass drum 12 by making the diameter of the tom-tom 13 larger than the diameter of the snare drum 14.

In the present embodiment, percussion instruments such as cymbals may be attached to the corresponding rod 23 via the attachment tools 24 instead of the tom-tom 13 and the snare drum 14. Alternatively, percussion instruments such as cymbals may be attached to the corresponding rod 23 via the attachment tools 24 in addition to the tom-tom 13 and the snare drum 14.

The invention claimed is:

1. A drum system comprising:

a first drum;

a second drum, which is a different type of drum from the first drum; and a plurality of legs for setting the first drum and the second drum along a vertical direction, the plurality of legs being arranged on at least one of outer circumferential surfaces of shells of the first drum and the second drum, wherein timbre of the first drum is different from timbre of the second drum, the first drum and the second drum are set with a drumhead of the first drum facing upward, and with a drumhead of the second drum facing downward, and the first drum is set above the second drum with a space therebetween.

2. The drum system according to claim 1, wherein a diameter of the first drum is different from a diameter of the second drum.

3. The drum system according to claim 1, wherein the drum system is configured such that a spatial distance between the first drum and the second drum is adjustable.

4. The drum system according to claim 3, further comprising:

rods for supporting the first drum above the second drum;

first brackets that are supported movably with respect to the rods and are fixed to the outer circumferential surface of the shell of the first drum; and second brackets that are supported movably with respect to the rods and are fixed to the outer circumferential surface of the shell of the second drum.

5. The drum system according to claim 4, wherein the first brackets and the second brackets each have a length dimension extending in a direction perpendicular to axes of the rods, wherein the length of the first brackets is different from the length of the second brackets.

6. The drum system according to claim 1, further comprising a connection mechanism for connecting a pedal apparatus for striking the second drum to the drum system, wherein the connection mechanism has two legs, which are included among the plurality of legs and are arranged at a player side, and a connection member connecting between the two legs, the pedal apparatus being connected to the connection member.

7. The drum system according to claim 4, further comprising:

an instrument different from the first drum and the second drum; and an attachment tool for attaching and removing the different instrument to and from the rods.

8. The drum system according to claim 7, wherein the different instrument is one of a third drum and a fourth drum, and a diameter of the third drum and a diameter of the fourth drum are set to be smaller than diameters of the first drum and the second drum.

9. The drum system according to claim 8, wherein the first drum is a snare drum or a tom, the second drum is a bass drum, the third drum is a snare drum or a tom, and the fourth drum is a snare drum or a tom.

* * * * *